US006192840B1

(12) United States Patent
Dürr et al.

(10) Patent No.: US 6,192,840 B1
(45) Date of Patent: Feb. 27, 2001

(54) DRIVE UNIT OF A HANDHELD WORK APPARATUS

(75) Inventors: Bernhard Dürr, Stuttgart; Karl-Heinz Klöpfer, Winnenden, both of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/362,227

(22) Filed: Jul. 28, 1999

(30) Foreign Application Priority Data

Jul. 29, 1998 (DE) ..... 298 13 484 U

(51) Int. Cl.[7] ..... F01P 7/02; F02F 7/00

(52) U.S. Cl. ..... 123/41.65; 123/195 R; 30/381

(58) Field of Search ..... 123/195 H, 198 E, 123/195 C, 41.56, 195 R, 41.65, 41.63, 196 R; 30/381, 383

(56) References Cited

U.S. PATENT DOCUMENTS 4,285,309 * 8/1981 Johansson ..... 123/195 C
4,700,480 * 10/1987 Rangert et al. ..... 30/383
4,872,308 * 10/1989 Nagai et al. ..... 60/316
5,029,393 * 7/1991 Nagashima et al. ..... 30/383
5,533,869 * 7/1996 Garrison et al. ..... 417/234

FOREIGN PATENT DOCUMENTS 4011929 10/1990 (DE) .

* cited by examiner

*Primary Examiner*—Andrew M. Dolinar
*Assistant Examiner*—Hai Huynh
(74) *Attorney, Agent, or Firm*—Walter Ottesen

(57) ABSTRACT

The invention relates to a drive unit of a portable handheld work apparatus such a motor-driven chain saw having an internal combustion engine. The crankshaft of the engine drives a tool of the work apparatus and a fan wheel. The fan wheel is held within a fan housing on a drive pin of the crankshaft. A crankcase is rigidly connected to a cylinder of the engine and is made of a metal material. The crankcase is configured of two parts and the axis of the crankshaft lies in the partition plane of the crankcase housing parts which can be connected to each other. A metallic chassis of the drive unit includes a crankcase sump as one of the crankcase halves and has a flange surface lying essentially perpendicularly to the crankshaft axis. The flange surface is at least defined in sections by the free-lying end of the crankcase sump. In this way, the weight and the manufacturing costs of the work apparatus are reduced. The fan housing is made of plastic and is attached to and lies against the flange surface with its housing base.

13 Claims, 5 Drawing Sheets

DRIVE UNIT OF A HANDHELD WORK APPARATUS

FIELD OF THE INVENTION

The invention relates to a drive unit of a portable handheld work apparatus such as a motor-driven chain saw.

BACKGROUND OF THE INVENTION

German patent publication 4,011,929 discloses a motor-driven chain saw wherein the drive unit includes an internal combustion engine. The crankshaft of the engine carries a chain sprocket at one end of the crankcase for driving a saw chain which moves around a guide bar. Furthermore, the crankshaft drives a fan wheel which is held on a drive pin of the crankshaft on the opposite side of the crankcase within a fan housing. The crankcase of the engine is made of a metal material and is configured of two parts. The axis of the crankshaft lies in the partition plane of the crankcase parts which can be connected to each other. The crankcase is rigidly connected to the cylinder of the engine. The upper part of the crankcase is cast with the cylinder as one piece and is unified with the lower part of the crankcase holding the piston.

The housing of the known drive unit includes a connecting base having a recess in which the engine can be seated with the crankcase in advance from above and can be tightly clamped to a flange-like configured receptacle part of the connecting base. The connecting base for the engine is seated in the handle frame in the known motor-driven chain saw. The handle frame is made of plastic which has a low weight while having high strength and excellent vibration damping characteristics. The total weight of the portable handheld work apparatus to be carried by the operator is intended to be low with respect to the best possible manipulability. The connecting base for accommodating the engine is used in the known motor-driven chain saw in order to facilitate assembly. The connecting base imparts the required stiffness to the force loaded total assembly; however, the component as an additional part increases the weight and the manufacturing costs.

SUMMARY OF THE INVENTION

It is an object of the invention to reduce the weight and the manufacturing costs of the work apparatus and especially the drive unit.

The drive unit of the invention is for a portable handheld work apparatus including a chain saw. The drive unit includes: an internal combustion engine having a cylinder including an upper crankcase half and a crankshaft defining a crankshaft axis; a work tool operatively connected to the crankshaft so as to be driven thereby; the crankshaft having a drive pin; a fan wheel attached to the drive pin; a fan housing made of plastic and being configured for accommodating the fan wheel therein; a metallic chassis including a crankcase sump as a lower crankcase half; the crankcase sump of the metallic chassis and the upper crankcase half conjointly defining a partition plane where the upper and lower crankcase halves are joined to each other; the metallic chassis having a flange surface lying essentially perpendicular to the crankshaft axis; the crankcase sump having an exposed end defining at least a portion of the flange surface; and, the fan housing having a housing base attached to the flange surface.

A metal chassis of the drive unit includes a crankcase sump as one of the two crankcase halves and supports the engine. The dynamic forces, which are generated by the crankshaft and the engine during operation, are taken up by the chassis with the known excellent material characteristics of the metal material. The fan housing is necessary for the operation of the engine but is not subjected to force. The fan housing is made of plastic and is attached with an end face thereof to a flange surface of the metal chassis so as to be in contact therewith. The end face lies essentially perpendicular to the crankshaft axis. In this way, the total weight of the drive unit is reduced by the high portion made of plastic. The plastic parts can be connected to the flange surface with only little complexity and the flange surface is configured essentially so as to be planar. The crankcase sump is configured as one piece with the metal chassis and purposefully lies opposite the cylinder with reference to the partition plane of the crankcase. The cylinder with the upper crankcase half cast thereon can be seated in the metal chassis during assembly of the drive unit and be joined to the crankcase sump. A seal is mounted in the flange plane between the metal chassis and the plastic housing.

The metal chassis advantageously includes a connecting anchor for attaching a guide element of the tool. The forces and torques, which occur during use of the portable work apparatus, and the torques are taken up by the metal chassis for mounting the engine and are directed to the carrying handle of the work apparatus so that no further heavy components are required herefor. The fan housing is advantageously connected to the chassis with threaded fasteners. The fastener heads are accessible from the fan housing to make a simple and rapid assembly possible.

A space for lubricant for the work tool is delimited in the chassis. The lubricant space is arranged close to the drive pin of the crankshaft for the tool of the work apparatus. A simple maintenance and filling is possible when the lubricant space is open in the flange plane and can be closed with a cover held with threaded fasteners. If the cover is made of plastic, then the total weight of the work apparatus is further reduced. The cover is advantageously made of plastic and is configured as one piece with the fan housing.

A savings of material and therefore a reduction of weight is possible when the fan housing is guided with a projection in the axial direction of the crankshaft below the metal chassis and lies against the housing wall. The metal housing wall can, as required, be configured with a thin wall because the housing wall is additionally supported by the contiguous plastic part. A cropped camshaft rotates in the region of the crankcase sump. Radial steps are formed in the wall of the chassis in this region and the plastic fan housing engages in the radial steps for further support of the crankcase sump.

BRIEF DESCRIPTION OF THE DRAWINGS

The invention will now be described with reference to the drawings wherein.

DESCRIPTION OF THE PREFERRED EMBODIMENTS OF THE INVENTION

Figure 5:
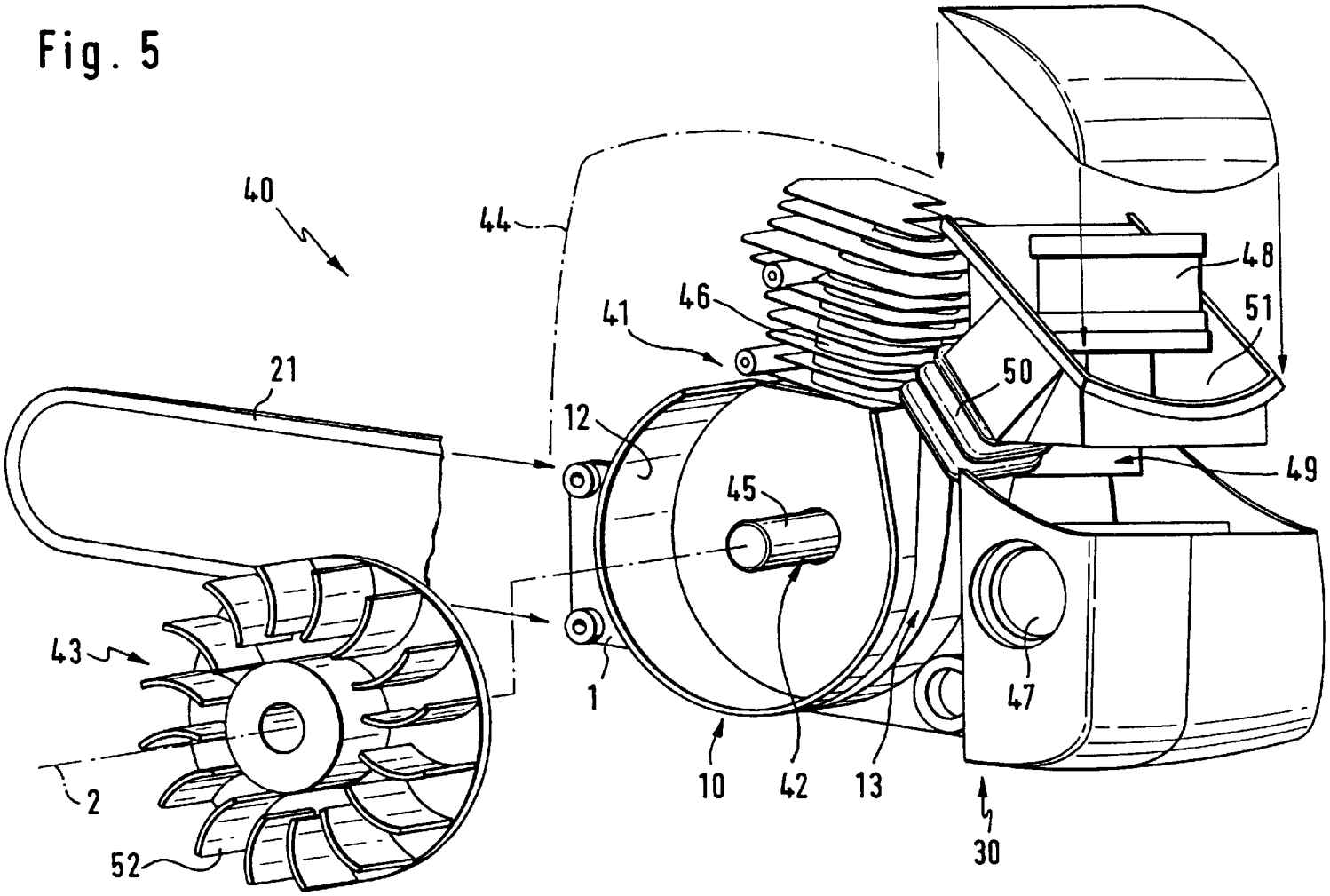

FIG. 5 shows a perspective view of a portable handheld work apparatus which, in the present embodiment, is a motor-driven chain saw 40. The drive unit 30 of the motor-driven chain saw 40 includes an internal combustion engine 41 which drives a saw chain with its crankshaft 42. The saw chain runs along the guide bar 21. The crankshaft 42 additionally drives a fan wheel 43 in rotation which is held on a drive pin 45 of the crankshaft 42 within a fan housing 10. The fan wheel 43 is provided with fan blades 52 which draw air by suction during the rotation of the fan wheel 43 and centrifugally throw the air against the peripheral wall 12 of the fan housing 10. The cooling air for the engine is guided along the peripheral wall 12 and is blown onto the cooling ribs of the cylinder 46 of the engine 41.

A combustion air channel 13 is formed on the fan housing 10 and a component air flow is branched off from the interior of the fan housing 10 to the cylinder 46 of the engine. The combustion air channel 13 opens via a stub 50 into an air filter box 49 having an interior space 51 in which a filter element 48 is mounted in the flow path of the combustion air. The drive unit further includes a fuel tank 47 from which the engine 41 is supplied with fuel. The drive unit 30 is accommodated in an engine housing 44 of the chain saw 40 and this housing is indicated in phantom outline. The drive unit 30, that is, its components and especially the engine 41 are carried on a chassis 1.

Figure 1:
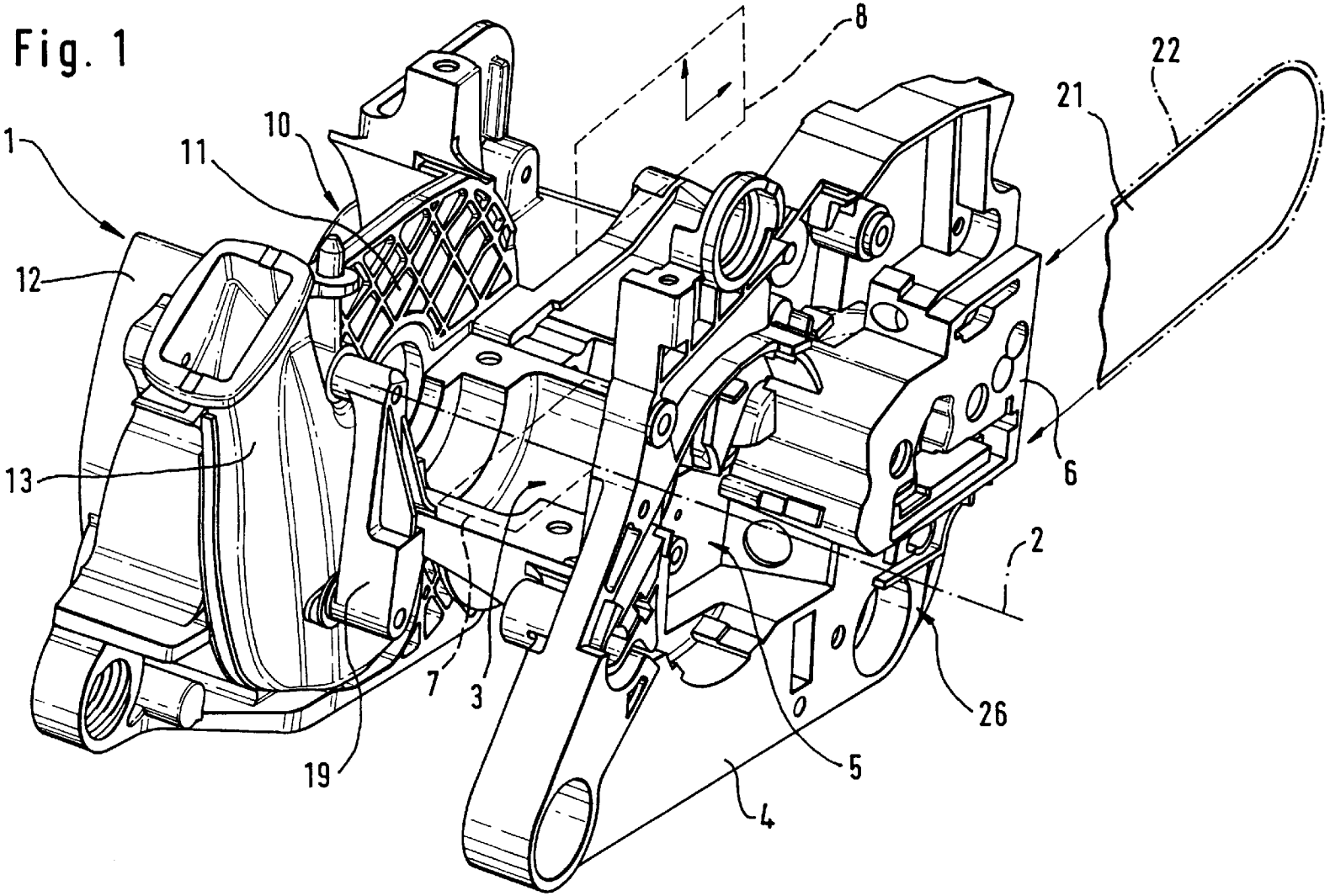
FIG. 1 is a perspective view of a chassis of a drive unit for a portable handheld work apparatus.

In FIG. 1, the chassis 1 of a drive unit of a motor-driven chain saw is shown in a perspective view. The chassis 1 accommodates the engine (not shown) which functions to drive the saw chain 22 which, in turn, runs on the guide bar 21. The chassis 1 comprises plastic and metal parts and the chassis part 4 is made of a pressure cast magnesium alloy. The metal chassis includes a one-piece cast crankcase sump 3 which defines a half of a partitioned crankcase of the engine. The axis 2 of the crankshaft lies in the partition plane 7 of the crankcase. The upper half of the crankcase is rigid and is preferably configured as one piece with the cylinder of the engine and, after the crankshaft is put in place, the upper half including a piston is joined to the crankcase sump 3. The crankcase sump 3 lies opposite to the cylinder with reference to the partition plane 7 of the crankcase and includes a flange surface on which the counter piece of the upper housing half is seated during assembly of the engine. The cylinder with the crankcase can be seated in a simple manner in the chassis and can be connected to the crankcase sump 3, preferably, via a threaded fastener connection.

The side surface 26 is perpendicular to the crankshaft axis 2 and a receiving opening 5 is formed therein. The drive pin of the crankshaft projects into this receiving opening 5 in the completely assembled work apparatus and drives a sprocket wheel for driving the saw chain 22. A clutch, such as a centrifugal clutch, can be mounted between the sprocket wheel and the crankshaft. The metallic chassis 4 includes a connecting anchor 6 next to the receiving opening 5 for the sprocket wheel. The connecting anchor 6 is provided for the attachment of the guide bar 21 for the saw chain 22. During operation of the motor-driven chain saw, the forces acting on the guide bar 21 are guided into the chassis via the anchor 6 formed as one piece in the metallic chassis 4.

The chassis 1 further includes a fan housing 10 which is configured as a guide spiral open to the engine. The crankshaft projects through an opening in the housing base 11 into the fan housing 10 and carries a fan wheel (not shown) which is covered over in the axial direction by the peripheral wall 12 of the fan housing 10. The engine drives the fan wheel which draws in fresh air by suction and guides the air to the peripheral wall for movement to the engine and blows the fresh air onto the cooling ribs. The fan housing 10 further includes a combustion air channel 13 through which a component flow of the air, which is drawn by suction by the fan wheel, is guided to the cylinder of the engine.

The metallic chassis 4 includes a flange surface lying essentially perpendicular to the axis 2 of the crankshaft and the fan housing 10 is attached to this flange surface. The free end of the crankcase sump 3 lies in the flange plane 8 and the housing base 11 of the fan housing 10 is attached so as to be in tight contact engagement in the region of the crankcase sump 3. The housing base 11 is made of plastic.

Figure 3:
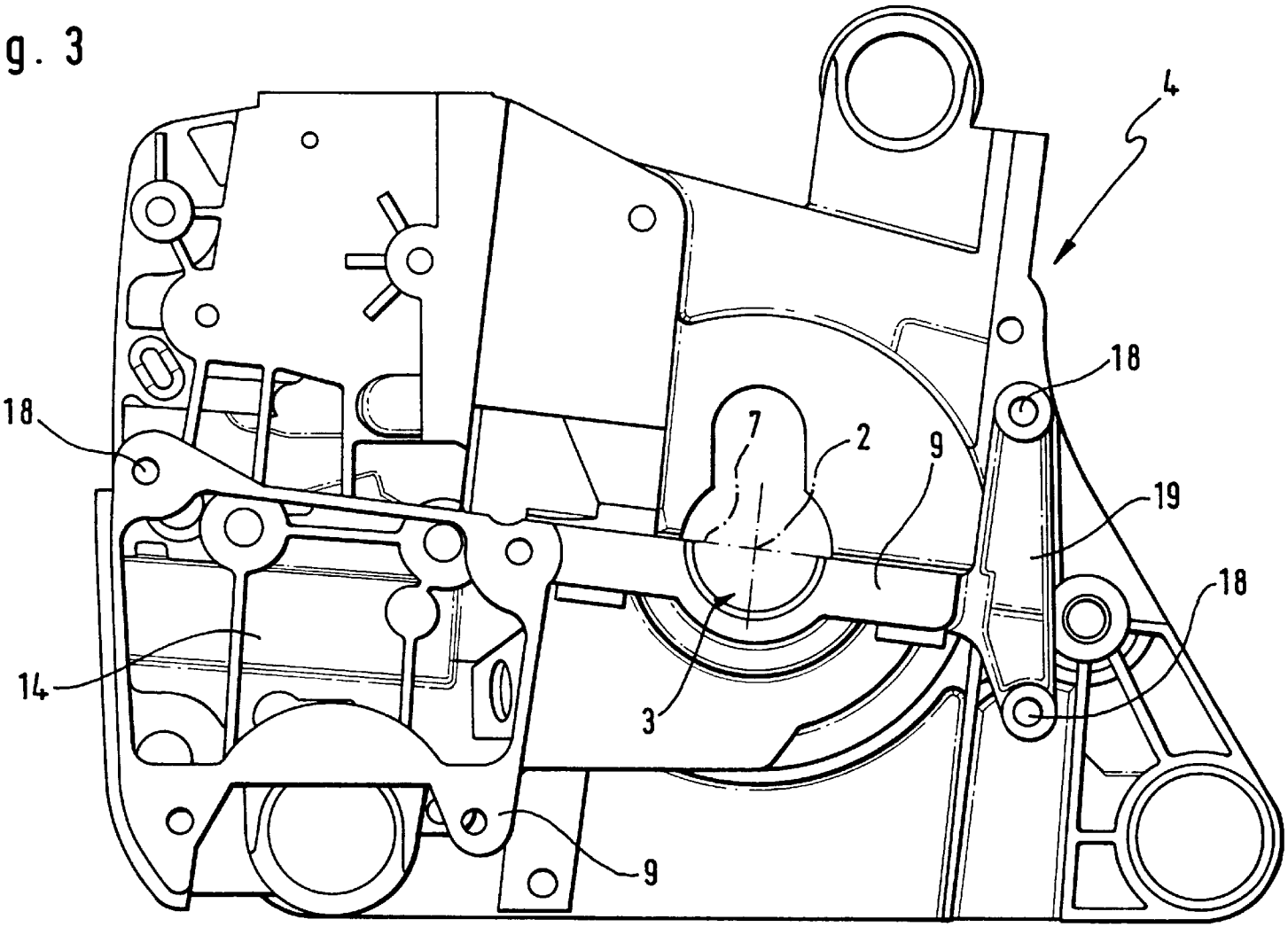
FIG. 3 is a side elevation view of the flange plane of the metallic chassis.

The flange 9 is configured so as to be perpendicular to the crankshaft axis 2 and can be seen in the plan view of FIG. 3 on the metallic chassis 4. Threaded bores 18 are provided in the flange 9 for accommodating attachment screws which are supported in the housing base for attaching the fan housing 10. The heads of the threaded fasteners are accessible from the fan housing so that a simple assembly of the drive unit is ensured.

A space 14 for lubricant is provided in the metallic chassis 4 and is formed in the metal body in the axial direction to of the crankshaft and contains lubricant for the saw chain of the motor-driven chain saw. The space 14 for the lubricant is open in the flange plane and its edge is part of the attachment flange 9 for the fan housing. A cover (not shown) of the lubricant space 14 is secured with threaded fasteners with a seal being interposed on the flange region formed by the lubricant space 14. The cover is tightly connected to the flange 9 at several locations which here are the four corners of the cross section of the lubricant space.

A compact configuration of the drive unit and a significant reduction in weight is achieved in that the cover of the lubricant space 14 is configured as one piece with the fan housing 10 and is made of light plastic. The cover is identified by reference numeral 15 in FIG. 2.

The seal 16 between the fan housing 10 made of plastic and the metallic chassis 4 is configured separately into a seal in the region of the crankcase sump 3 and for sealing the lubricant cover 15. A continuous seal 16 in the flange plane 8 can also be advantageous.

The lubricant space 14, which is configured essentially in the metallic chassis 4, can also be expanded in its volume by an axial projection 14' in the plastic part. Free spaces remain between the individual elements (combustion air channel 13, fan housing 10, plastic housing 14' of the lubricant space). To increase the form stiffness of the plastic housing 10, the free spaces are filled with a light and form-stable honeycomb structure which forms the housing base 23 of the plastic part.

Figure 2:
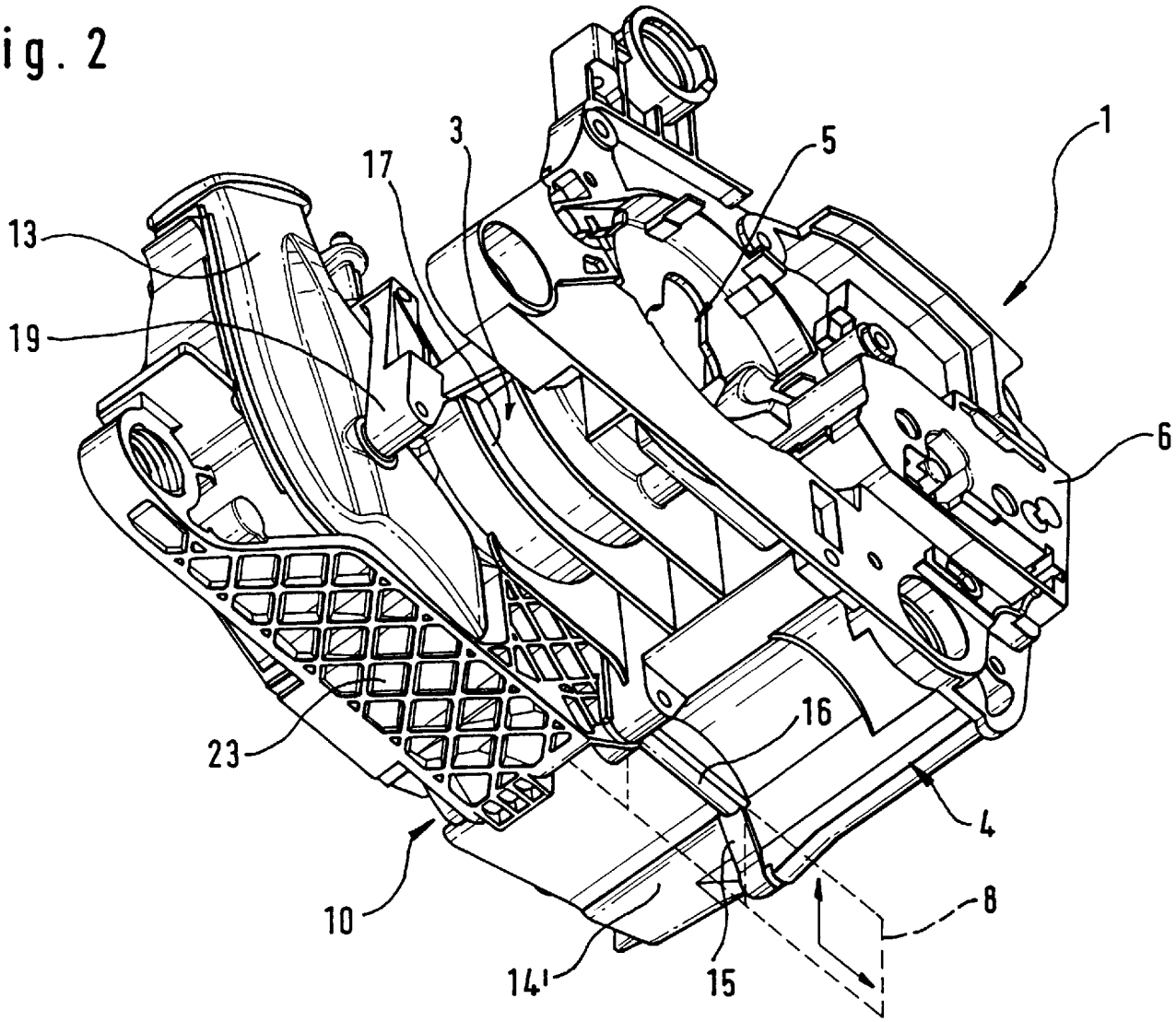
FIG. 2 is a perspective view of the rearward end of the chassis of FIG. 1.

A stiffening connection of the combustion air channel to the metallic chassis 4 is purposeful especially for elongated embodiments of the combustion air channel. A strut 19 is shown in FIGS. 1 to 3 and is rigidly supported on the crankcase sump 3 and is connected on both sides of the partition plane 7 of the crankcase sump 3 to the combustion air channel 13. The strut 19 provides a more reliable connection of the entire plastic part 10 to the metallic chassis 4 via an enlargement of the effective supporting surface. Referring to FIG. 3, two additional support points are given by the strut 19 on the side of the crankshaft axis 2 lying opposite to the lubricant space 14. The two further support points lie on both sides of the partition plane 7 of the crankcase sump 3.

The treaded bores 18 in the strut 19 do not lie on the fictitious line through the possible bore pair of the connections 18 in the flange region of the lubricant space 14 whereby the bending stress in the chassis (especially in the plastic part) are held low. The connecting points 18 of the strut 19 counter the torques about an intercept axis of the partition plane 7 of the crankcase sump and the flange plane. These connecting points 18 lie spaced from the partition plane 7.

The weight of the metallic chassis 4 is reduced in the region of the crankcase sump 3 by a comparatively narrow wall thickness. The stiffness of the crankshaft is given by reinforcement ribs 17 lying radially to the crankshaft axis 2.

Figure 4:
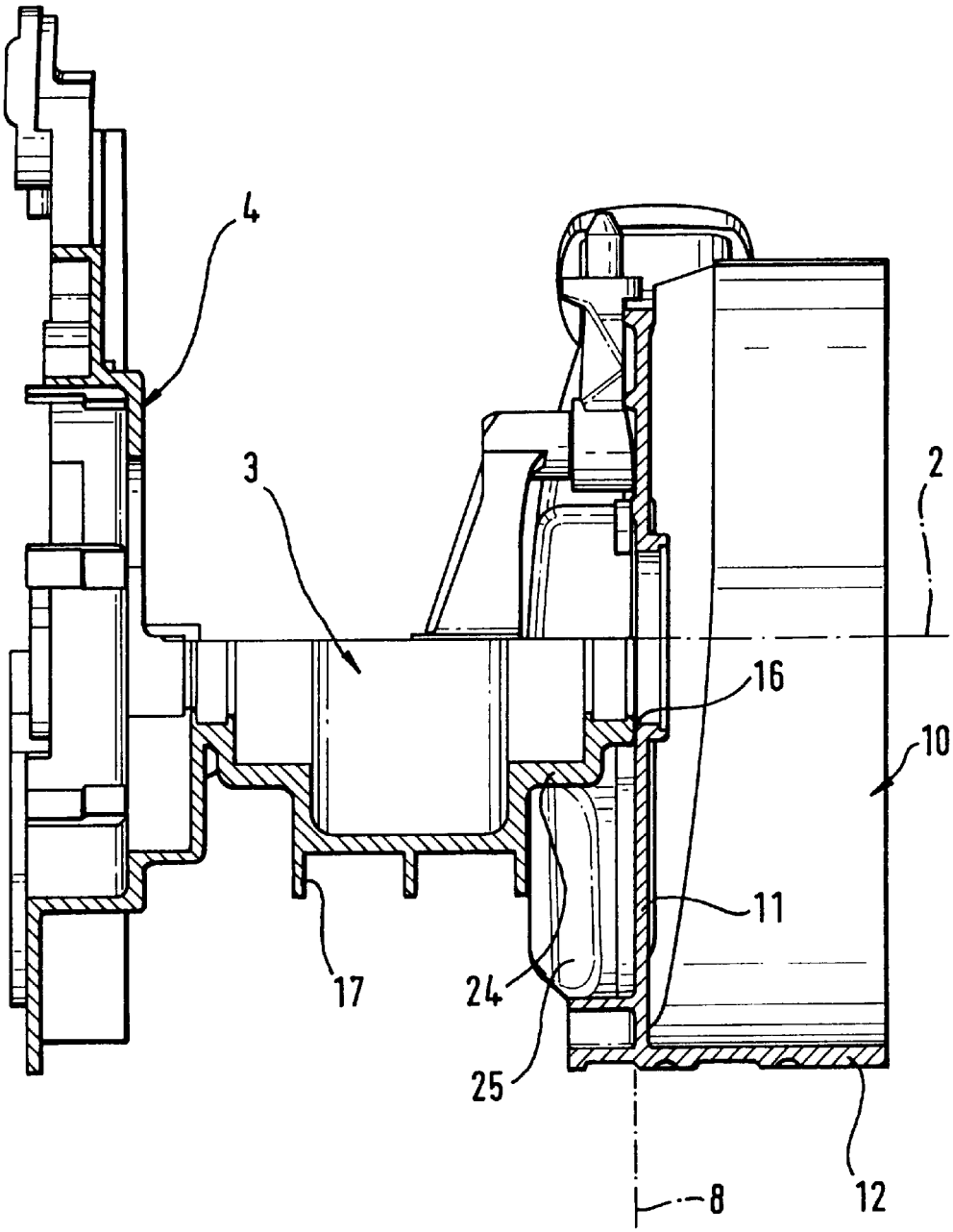
FIG. 4 is a front elevation view, partially in section, of the chassis; and, FIG. 5 is a perspective view of the portable handheld work apparatus.

In the section view of the metal chassis 4 of FIG. 4, it can be clearly seen that the wall of the crankcase sump 3 is provided with steps 24 corresponding to the course of the cropped crankshaft arranged in the crankcase sump 3. The plastic housing 10 lies tightly against the metallic chassis 4 with its housing base 11. The plastic housing 10 extends under the crankcase sump 3 and lies on the housing wall of the metallic chassis 4.

An additional seal 16 can be arranged in the flange plane 8 between the housing base 11 and the metallic chassis 4. The seal 16 is provided as a separate seal component or as a common seal with the region of the free end of the crankcase sump 3 in the flange section of the lubricant space. The extension 25 of the fan housing 10 is guided beyond the flange plane 8 and engages in the steps 24 of the crankcase sump 3. The stiffening of the crankcase sump 3 by means of the reinforcement ribs 17 defines a compact configuration for a mutual support of the large area metal and plastic parts which lie one against the other.

It is understood that the foregoing description is that of the preferred embodiments of the invention and that various changes and modifications may be made thereto without departing from the spirit and scope of the invention as defined in the appended claims.

What is claimed is:

1. A drive unit of a portable handheld work apparatus including a chain saw, the drive unit comprising:

an internal combustion engine having a cylinder including an upper crankcase half and a crankshaft defining a crankshaft axis;

a work tool operatively connected to said crankshaft so as to be driven thereby;

said crankshaft having a drive pin;

a fan wheel attached to said drive pin;

a fan housing made of plastic and being configured for accommodating said fan wheel therein;

a metallic chassis including a crankcase sump as a lower crankcase half;

said crankcase sump of said metallic chassis and said upper crankcase half conjointly defining a partition plane where said upper and lower crankcase halves are joined to each other;

said metallic chassis having a flange surface lying essentially perpendicular to said crankshaft axis;

said crankcase sump having an exposed end defining at least a portion of said flange surface; and, said fan housing having a housing base attached to said flange surface.

2. The drive unit of claim 1, said crankcase sump lying opposite said cylinder with respect to said partition plane and said crankshaft axis lying in said partition plane.

3. The drive unit of claim 1, further comprising a guide member for guiding said work tool thereon; and, said metallic chassis 11 including a connecting base for attaching said guide member to said metallic chassis.

4. The drive unit of claim 3, further comprising threaded fasteners for fastening said fan housing to said connecting base; and, said threaded fasteners being accessible from said fan housing.

5. The drive unit of claim 1, said metallic chassis delimiting a lubricant space.

6. The drive unit of claim 5, said lubricant space being open in said flange surface and said drive unit further comprising a cover for closing said lubricant space and said cover being held in place with threaded fasteners.

7. The drive unit of claim 6, further comprising a cover for said lubricant space and said cover being configured as one piece with said fan housing.

8. The drive unit of claim 1, said crankcase sump having an external surface and a plurality of reinforcement ribs formed on said external surface so as to extend radially to said crankshaft axis.

9. The drive unit of claim 8, said metallic chassis having a housing wall; and, said fan housing extending below said metallic chassis and being in contact engagement with said housing wall.

10. The drive unit of claim 9, said crankcase sump having a wall defining a plurality of steps; and, said metallic chassis having radial intermediate spaces formed by said steps and said fan housing engaging said intermediate spaces in a form-tight manner.

11. The drive unit of claim 1, further comprising a combustion air channel formed on said fan housing through which air is conducted from the interior space of said fan housing to said engine.

12. The drive unit of claim 11, further comprising a strut supported on said metallic chassis and being connected to said combustion air channel on both sides of said partition plane.

13. The drive unit of claim 1, further comprising a seal arranged on said flange surface and disposed between said metallic chassis and said fan housing.

* * * * *

UNITED STATES PATENT AND TRADEMARK OFFICE

CERTIFICATE OF CORRECTION

PATENT NO. : 6,192,840 B1
DATED : February 27, 2001
INVENTOR(S) : Bernhard Durr and Karl-Heinz Kloepfer It is certified that error appears in the above-identified patent and that said Letters Patent is hereby corrected as shown below:

Column 6,
Line 12, delete "11".

Signed and Sealed this

Thirtieth Day of October, 2001

*Attest:*

Nicholas P. Godici

NICHOLAS P. GODICI
*Acting Director of the United States Patent and Trademark Office*

*Attesting Officer*